US006384520B1

(12) United States Patent
Russ

(10) Patent No.: US 6,384,520 B1
(45) Date of Patent: May 7, 2002

(54) CATHODE STRUCTURE FOR PLANAR EMITTER FIELD EMISSION DISPLAYS

(75) Inventor: Benjamin E. Russ, San Diego, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/449,317

(22) Filed: Nov. 24, 1999

(51) Int. Cl.[7] ..... H01J 1/05; H01J 1/14; H01J 1/38; H01J 1/48; H01J 19/06

(52) U.S. Cl. ..... 313/311; 313/326; 313/309; 313/346 R; 313/495

(58) Field of Search ..... 313/495, 496, 313/497, 309, 311, 293, 346 R, 351, 336, 326

(56) References Cited

U.S. PATENT DOCUMENTS

| | | | | |
|---|---|---|---|---|
| 4,143,292 A | | 3/1979 | Hosoki et al. | 313/336 |
| 4,305,188 A | | 12/1981 | Momoi | 29/25.17 |
| 4,766,340 A | * | 8/1988 | van der Mast et al. | 313/309 |
| 4,857,161 A | * | 8/1989 | Borel et al. | 313/309 |
| 5,229,331 A | * | 7/1993 | Doan et al. | 313/309 |
| 5,243,252 A | * | 9/1993 | Kaneko et al. | 313/309 |
| 5,319,279 A | | 6/1994 | Watanabe et al. | 313/309 |
| 5,332,627 A | | 7/1994 | Watanabe et al. | 428/426 |
| 5,394,006 A | * | 2/1995 | Liu | 313/336 |
| 5,534,749 A | | 7/1996 | Ohoshi et al. | 313/497 |
| 5,608,283 A | | 3/1997 | Twichell et al. | 313/309 |
| 5,747,918 A | | 5/1998 | Eom et al. | 313/309 |
| 5,755,944 A | | 5/1998 | Haven et al. | 204/486 |
| 5,783,906 A | | 7/1998 | Moore et al. | 313/586 |
| 5,813,892 A | | 9/1998 | Spindt et al. | 445/24 |
| 5,828,162 A | | 10/1998 | Danroc et al. | 313/309 |
| 6,104,131 A | * | 8/2000 | Clerc | 313/336 |
| 6,144,144 A | * | 11/2000 | Cleeves et al. | 313/309 |

FOREIGN PATENT DOCUMENTS

| | | | |
|---|---|---|---|
| EP | 0 913 508 | 5/1999 | D01F/9/127 |
| JP | 08 227655 | 9/1996 | H01J/9/02 |
| JP | 8-241664 | 9/1996 | H01J/1/30 |

OTHER PUBLICATIONS

Spindt, et al., "Physical properties of thin–film field emission cathodes with molybdenum cones", Journal of Applied Physics, vol. 47, No. 12, pp. 5248–5263, Dec. 1976.

Itoh, et al., "Investigation of Cathodoluminescent Display Device with Field Emission Cathodes", Jpn. J. Appl. Phys. vol. 32, part 1, No. 9A, pp. 3955–3961, Sep. 1993.

* cited by examiner

*Primary Examiner*—Nimeshkumar D. Patel
*Assistant Examiner*—Mariceli Santiago
(74) *Attorney, Agent, or Firm*—Skjerven Morrill MacPherson LLP; David W. Heid

(57) ABSTRACT

A cathode structure for use in field emission display (FED) devices includes four layers. A first layer consists of conducting lines supported on an insulating substrate. A second layer consists of thin non-conducting lines crossing the conducting lines. A third layer consists of a thick layer of non-conducting material with holes centered between the thin non-conducting lines of the second layer and extending over a portion of the thin non-conducting lines. A fourth layer consists of conducting lines containing holes of the same dimension as and aligned with the holes in the third layer exposing portions of the conducting lines of the first layer and of the non-conducting lines of the second layer. Emissive material is deposited on the exposed portions of the conducting lines of the first layer to produce a cathode for an FED device. The four-layer cathode structure improves emission characteristics such as current density and uniformity for planar edge emitters and surface emitters.

14 Claims, 2 Drawing Sheets

CATHODE STRUCTURE FOR PLANAR EMITTER FIELD EMISSION DISPLAYS

TECHNICAL FIELD

This invention relates generally to field emission display devices, and in particular, to cathode structures for field emission devices.

BACKGROUND

Field emission displays (FEDs) are flat panel display devices that combine the size and portability advantages of liquid crystal displays (LCDs) with the performance of conventional cathode ray tubes (CRTs). FED devices typically include a field emission cathode positioned opposite a flat screen coated with phosphors. The phosphors emit light in response to bombardment by electrons from the cathode to produce an image. The field emission cathode emits electrons when subjected to an electric field of sufficient strength. The cathode typically includes thousands of microscopic emitter tips for each pixel of the screen. It is principally the emissive nature of the cathode that give FEDs the thin, flat screen features of an LCD with the viewing angle, brightness, and response speed of a CRT.

While FEDs are potentially very attractive devices, a limiting factor in the widespread adoption of the technology is the difficulty of manufacturing the devices, particularly the difficulty in manufacturing the FED cathodes. Field emission cathodes have been known for some time. See, for example, Spindt et al. J. of Appl. Phys. 47, 5248 (1976). The field emission cathodes described therein typically comprise sharp-tip metal electron emitters, such as molybdenum cones having a tip radius of the order of a few tens of nanometers. A method of manufacturing such cathodes with Mo cone emitters on a conductive substrate using semiconductor fabrication techniques is described, of example, in U.S. Pat. No. 5,332,627 to Watanabe et al. Another example of the use of semiconductor fabrication techniques, including patterning and etching, to manufacture emitter cone structures is provided in U.S. Pat. No. 5,755,944 to Haven et al.

Because of the difficulty of manufacturing metal cone emitters, planar emitters have been identified as alternative emitters for use in field emission cathodes. Planar emitters typically fall into two classes: edge emitters and surface emitters. Edge emitters emit electrons from the very edge of a layer of material regardless of the amount of material present, while surface emitters emit electrons from an entire surface area.

The performance of emitting materials in field emission cathodes is largely dependent on the design of the cathode structure. While cathode structures for sharp-tip metal cone emitters have been thoroughly investigated, cathode structures for planar emitters, both edge emitters and surface emitters, are not as well developed. Thus, there is a need for improved cathode structures for planar emitters for use in field emission displays.

SUMMARY

A four-layer cathode structure for use in field emission display (FED) devices improves emission characteristics, such as current density and uniformity, for edge emitters and surface emitter. An image is displayed on an FED device in terms of pixels, each made up of multiple sub-pixels. A first layer of the four-layer cathode structure consists of conducting lines. The first layer is supported on an insulating substrate. The width of the conducting lines is smaller than the sub-pixel size. A second layer consists of thin non-conducting lines crossing the conducting lines. A third layer consists of a thick layer of non-conducting material with holes centered between the thin non-conducting lines of the second layer and extending over a portion of the thin-non-conducting lines. The fourth layer of the cathode structure consists of conducting lines containing holes of the same dimension as, and aligned with, the holes in the third layer. Because the holes in the third and fourth layers are aligned, portions of the conducting lines of the first layer and of the non-conducting lines of the second layer are exposed.

To complete the manufacture of a field emission cathode, emissive material is deposited onto the portions of the conducting lines of the first layer exposed through the aligned holes in the third and fourth layers of the cathode structure. For planar edge emitters, the emitting region is the edge of the emitter-covered conducting lines. The four-layer cathode structure insures that the emitting edges are completely exposed. The thin non-conducting lines isolate the emitting material and prevent it from wicking up the edges of the holes and creating short circuit with the fourth layer of conducting lines. Thus, the four-layer cathode structure improves FED device performance.

BRIEF DESCRIPTION OF THE DRAWINGS

In FIG. 3*b*, the third layer is depicted as transparent revealing the second layer below it.

In FIG. 4*b*, the third and fourth layers are depicted as transparent.

The use of the same reference symbols in different drawings indicates similar or identical items.

DETAILED DESCRIPTION

All field emission cathodes are made up of multiple layers of material including layers of conducting material, non-conducting material, and emitting material. Typically, the emitting material is deposited on a layer of conducting material called the cathode line. A non-conducting material surrounds the emitting material and a second layer of conducting material spaced a small distance from the emitting material forms the gate electrode. An electric field between the gate electrode and the cathode line causes the emitting material to emit electrons. In a Field Emission Display (FED) device, electrons from the cathode strike a phosphor coated screen positioned opposite the cathode in a rectangular grid of pixels. Each pixel is made up of sub-pixels, typically arranged in a rectangular grid. The sub-pixels include multiple sub-pixels for each of the primary colors, red, green, and blue. In an exemplary implementation, each pixel is made up of nine sub-pixels, three for each color.

A cathode structure for planar emitters, according to the present invention, includes four layers as illustrated in FIGS.

1, 2*a*, 2*b*, 3*a*, 3*b*, 4*a* and 4*b*. As described above, planar emitters are classified as edge emitters or surface emitters. The present four-layer cathode structure improves emission characteristics, such as current density and uniformity, for edge emitters. In addition, the present design also provides benefits for surface emitting materials.

Figure 1:
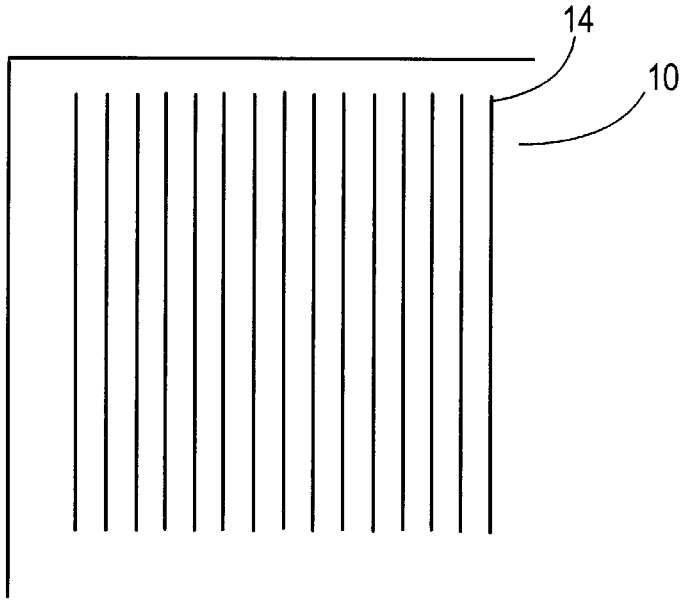
FIG. 1 is a top down view of the first layer of a four-layer cathode structure according the to the present invention.

The first layer of the four layer cathode structure is shown in FIG. 1. Conducting lines 14 are patterned into a substrate 10 such that their width is smaller than a sub-pixel size of the field emission display device in which the cathode is used. As shown in FIG. 1, conducting lines 14 are substantially parallel to each other. Frequently aluminum or gold is used for conducting lines 14. Alternatively, other metals such as chromium, or metal oxides such as indium tin oxide or chromium oxide, are used for conducting lines 14. Substrate 10 is made of a rigid insulating material such as glass, ceramic, or plastic. The spacing 12 between conducting lines 14 determines the resolution of the FED device. For an exemplary FED device with a resolution of 300 $\mu$m and nine sub-pixels per pixel, arranged in a 3×3 array, a characteristic size for spacing 12 is 100 $\mu$m, defined as shown in the enlargement in FIG. 2*b*, and a characteristic width 13 of conducting lines 14 is 30 $\mu$m.

Figure 2A:
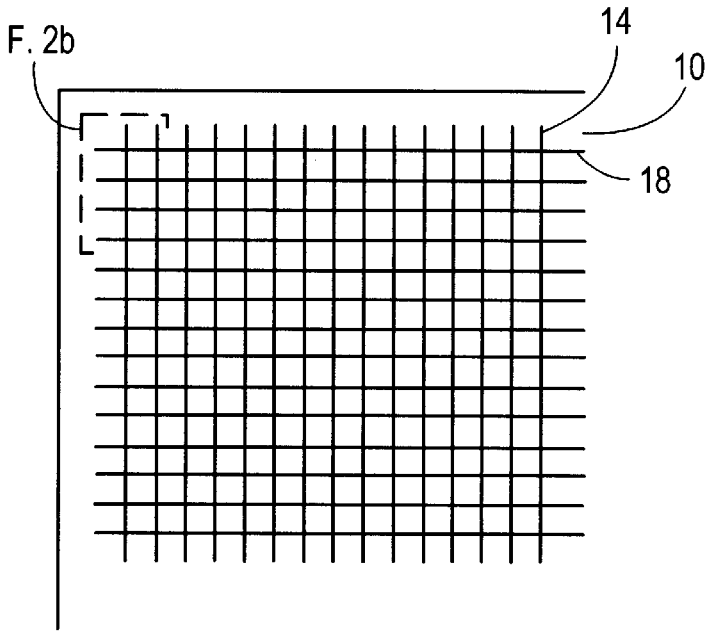
FIG. 2*a* is a top down view of the first two layers of the four layer cathode structure.
Figure 2B:
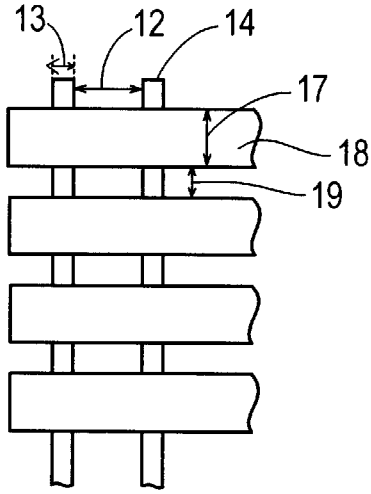
FIG. 2*b* is an enlarged view of upper left corner of FIG. 2*a* marked by reference F.2*b*.

The second layer consists of thin non-conducting lines 18 crossing conducting lines 14 as shown in FIGS. 2*a* and 2*b*. Thin non-conducting lines 18 are generally perpendicular to conducting lines 14. To produce the second layer, a thin layer of non-conducting material is patterned onto the first layer to produce thin lines 18. Particular examples of non-conducting material used for thin lines 18 include silicon dioxide, spin-on-glass materials, and polyimides. Additional non-conducting materials include γ-alumina, other alumina phases such as α-, β-, δ-, and ζ-alumina, silicon carbide, and oxides of titanium and zirconium. The terminology "thin" describing lines 18 refers to their dimension in the direction perpendicular to the plane of FIGS. 2*a* and 2*b*. A characteristic thickness for thin lines 18 in the perpendicular direction is in the range of from about 500 Å to about 5000 Å. For the 300 $\mu$m resolution example with a 50 $\mu$m sub-pixel diameter, a characteristic dimension of the width 17 of non-conducting line 18 is 70 $\mu$m and the inter-line spacing 19 is equal to 30 $\mu$m.

Figure 3A:
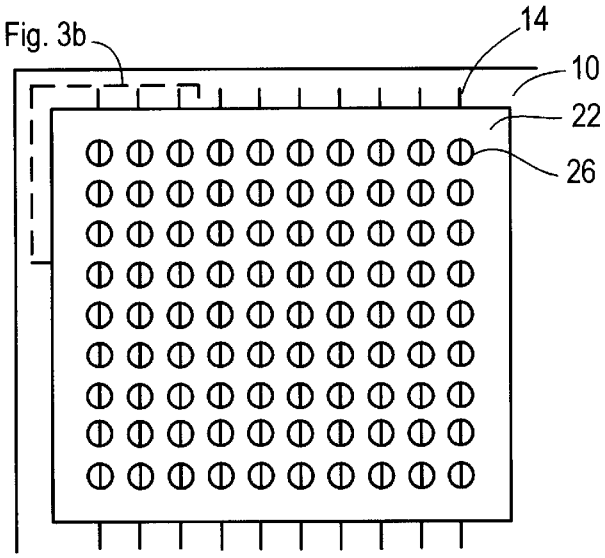
FIG. 3*a* is a top down view of the first three layers of the four layer cathode structure. Note that the second layer is completely covered by the third layer.
Figure 3B:
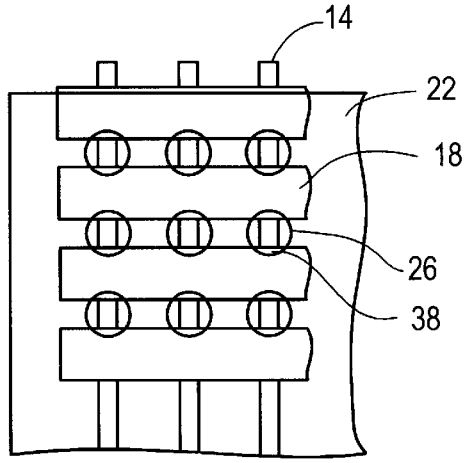
FIG. 3*b* is an enlarged view of the upper left corner of FIG. 3*a* marked by reference F.3*b*.

FIGS. 3*a* and 3*b* illustrate the third layer of the four-layer cathode, consisting of thick non-conducting layer 22 with holes 26 centered between the thin non-conducting lines 18. The holes 26 expose the conducting lines 14 of the first layer and small portions 38 of thin non-conducting lines 18. The holes 26 have the sub-pixel diameter, in the present example 50 $\mu$m, and are evenly spaced with an interhole spacing, in both horizontal and vertical directions, of 50 $\mu$m. The terminology "thick" refers to the thickness in the direction perpendicular to the plane of the figures. Non-conducting layer 22 is typically from about 5 to about 10 $\mu$m thick in the perpendicular direction. The non-conducting materials described above for thin non-conducting lines 18 are also used for thick non-conducting layer 22. However, layer 22 is typically composed of a different material than lines 18 to provide etch selectivity between the second and third layers during the process of making the cathode, discussed below. Alternatively, if layer 22 and lines 18 are composed of the same material, an etch-stop layer, or barrier layer, is included over lines 18 to provide etch selectivity during manufacturing.

Figure 4A:
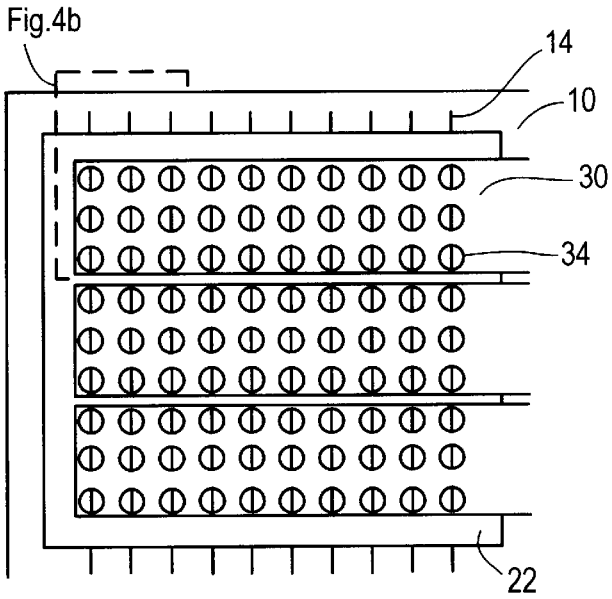
FIG. 4*a* is a top down view of the four layers of the four layer cathode structure.
Figure 4B:
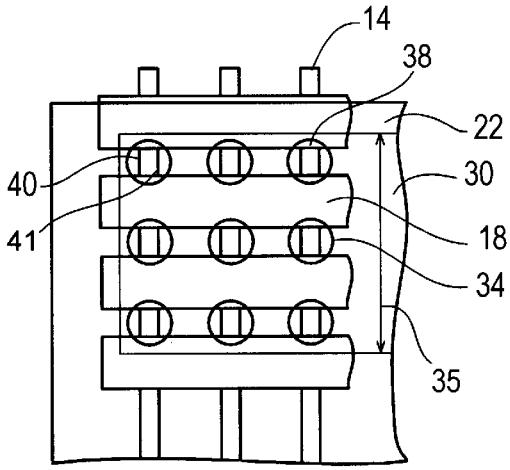
FIG. 4*b* is an enlarged view of upper left corner of FIG. 4*a* marked by reference F.4*b*.

The fourth layer of the cathode structure is shown in FIGS. 4*a* and 4*b*. The fourth layer consists of conducting lines 30 containing holes 34 of the same dimension as and aligned with holes 26 in the thick non-conducting layer 22. Conducting lines 30 are generally perpendicular to conducting lines 14 in the first layer. In the present example of nine sub-pixels per pixel in a 3×3 grid, each conducting line 30 overlies three rows of sub-pixels and has a characteristic width 35 of 275 $\mu$m. Conducting lines 30 are made of the same materials as described for conducting lines 14 and constitute the gate electrodes for the FED cathode.

The four-layer cathode can be produced using standard semiconductor fabrication techniques. For example, to produce the first layer, a photoresist layer is deposited on the substrate 10 and patterned by photolithography into the line pattern of conducting lines 14. The empty lines are filled with metal, for example, by evaporation or sputtering, and the photoresist layer is stripped. For the second layer, non-conducting material is deposited in a photoresist layer patterned with lines by chemical vapor deposition, physical vapor deposition, thermal evaporation or a spin-on process, as conventionally used for the particular non-conducting material. Next, a continuous, thick, non-conducting layer is deposited by one of the above customary processes.

To produce the fourth layer, continuous conducting lines are deposited into a photoresist layer patterned with lines. The line-patterned photoresist layer is removed and a new layer of photoresist is deposited and patterned in the pattern of holes 34. Holes 34 in conducting lines 30 and holes 26 in thick non-conducting layer 22 are created by etching through the same photoresist mask with an appropriate change of process gas for the different layers. Thus, it is assured that the holes in the third and fourth layers are aligned. Because holes 34 in the fourth layer and holes 26 in the third layer are aligned, portions of conducting lines 14 and small portions 38 of thin non-conducting lines 18 are exposed in the cathode. Because the thin non-conducting lines 18 are made of a different material than thick non-conducting layer 22, it is possible to etch completely through the third layer without etching the second layer. Alternatively, if the second and third layers are of the same material, an additional etch-stop layer of a different composition than the composition of the second and third layers, deposited over the lines 18 of the second layer provides etch selectivity.

The four-layer cathode structure provides electrically and physically isolated regions of conducting lines 14 on which emissive material is deposited to produce a field emission cathode. The emissive material may be deposited by an electrophoretic deposition process as described in the commonly assigned U.S. patent application Ser. No. 09/373,028. For planar edge emitters, the emitting region is the left and right edges, 40 and 41, respectively, of the portion of conducting lines 14 exposed through holes 26 and 34. When a voltage is applied to conducting lines 30, an enhanced field strength along edges 40 and 41, compared to the field strength at the center of the exposed region of conducting lines 14, causes electron emission from emissive material in the region of edges 40 and 41.

The four-layer cathode structure according to the present invention, insures the emitting edges are completely exposed. Furthermore, the presence of the second layer of thin non-conducting lines insures that the exposed part of conducting lines 14 is centered in the holes. The thin non-conducting lines isolate the emitting material and prevent it from wicking up the edges of the holes and creating a short circuit with the gate electrode, that is with the fourth layer of conducting lines. It will be readily apparent that the design of the present four-layer cathode structure provides similar benefits for planar surface emitters where sufficient voltage is applied that emission originates from the entire exposed surface of conducting lines 14.

Although the invention has been described with reference to a specific design for a four-layer field emission cathode, the description is only an example of the invention's application and should not be taken as a limitation. In particular, the dimensions provided are exemplary only. Various adaptations and combinations of features of the structure disclosed and modifications of the dimensions are within the scope of the invention as defined by the following claims.

I claim:

1. A cathode comprising:

substantially parallel first conducting lines;

non-conducting lines overlying the conducting lines, the non-conducting lines extending in a direction generally perpendicular to the first conducting lines;

a non-conducting layer overlying the non-conducting lines, the non-conducting layer comprising holes, each hole having a diameter greater than a width of the first conducting lines; and second conducting lines overlying the non-conducting layer, the second conducting lines comprising holes aligned with the holes in the non-conducting layer such that portions of the first conducting lines and portions of the non-conducting lines are exposed through the holes in the non-conducting layer and the holes in the second conducting lines.

2. The cathode of claim 1 wherein a portion of only one first conducting line is exposed through each hole in the second conducting lines.

3. The cathode of claim 1 wherein no edge of the first conducting lines is directly aligned with a circumference of the holes in the second conducting lines.

4. The cathode of claim 1 wherein the thickness of the non-conducting lines is substantially smaller than the thickness of the non-conducting layer.

5. The cathode of claim 4 wherein the thickness of the non-conducting lines is in the range of from about 500 Å to about 5000 Å.

6. The cathode of claim 1 wherein the non-conducting lines comprise a first material and the non-conducting layer comprises a second material, wherein the first material is different than the second material.

7. The cathode of claim 1 wherein the first conducting lines comprise a material selected from the group consisting of aluminum, gold, chromium, inidium tin oxide, and chromium oxide.

8. The cathode of claim 1 wherein the second conducting lines comprise a material selected from the group consisting of aluminum, gold, chromium, inidium tin oxide, and chromium oxide.

9. The cathode of claim 1 wherein the non-conducting lines comprise a material selected from the group consisting of silicon dioxide, spin-on-glass materials, polyimides, alumina, silicon carbide, titanium oxide, and zirconium oxide.

10. The cathode of claim 1 wherein the non-conducting layer comprises a material selected from the group consisting of silicon dioxide, spin-on-glass materials, polyimides, alumina, silicon carbide, titanium oxide, and zirconium oxide.

11. A field emission display device comprising the cathode of claim 1 and further comprising emissive material overlying the portions of the conducting lines exposed through the holes in the second conducting lines.

12. The cathode of claim 1 wherein the each of the holes of the nonconducting layer is centered between adjacent non-conducting lines.

13. The cathode of claim 1 wherein each of the holes of the nonconducting layer is centered with respect to the width of an associated underlying first conducting line.

14. The cathode of claim 1 wherein the second conducting lines extend in a direction generally perpendicular to the first conducting lines.

* * * * *